United States Patent [19]

Horvath

[11] Patent Number: 4,657,441

[45] Date of Patent: Apr. 14, 1987

[54] PENETRATION CONDUCTOR PIPE DRIVE SHOE

[75] Inventor: Louis Horvath, Norwich, England

[73] Assignee: HSA, Inc., New Orleans, La.

[21] Appl. No.: 660,917

[22] Filed: Oct. 15, 1984

[51] Int. Cl.[4] ..... E02D 7/14

[52] U.S. Cl. ..... 405/254; 405/253; 405/231; 175/403; 175/413; 175/402

[58] Field of Search ..... 405/253, 254, 184, 232, 405/231; 175/402, 412, 413, 171, 19, 56

[56] References Cited

U.S. PATENT DOCUMENTS

| | | | |
|---|---|---|---|
| 228,467 | 6/1880 | Maclay | 405/254 |
| 1,110,284 | 9/1914 | Bienhoff | 175/402 X |
| 1,290,412 | 1/1919 | Trakimas | 175/412 X |
| 2,022,194 | 11/1935 | Galvin | 175/413 X |
| 2,874,547 | 2/1959 | Fiore et al. | 405/254 |
| 3,331,455 | 7/1967 | Anderson et al. | 175/403 |
| 3,384,188 | 5/1968 | Bodine | 175/171 X |
| 3,633,688 | 1/1972 | Bodine | 175/56 X |

FOREIGN PATENT DOCUMENTS

| | | | |
|---|---|---|---|
| 372349 | 6/1939 | Italy | 174/402 |

*Primary Examiner*—Dennis L. Taylor

*Attorney, Agent, or Firm*—Alexander F. Norcross

[57] ABSTRACT

An improved drive shoe is shown for installation on the penetrating end of a string of conductor pipe, for improving driving penetration through soil. The improved shoe has a reinforced cylindrical driving section. A symmetrical, toothed beveled penetration end improves penetration through loose and unconsolidated media, and minimizes displacement resistance by symmetrically displacing soil to both the inner bore of the conductor pipe and externally along the outer surface of the conductor pipe. A repeating pattern of straight exterior vertical bar segments breaks up the exterior soil, easing passage of the conductor pipe through the soil. A spiral inner bar section within the drive shoe breaks adhesion of the center soil plug to the bore of the conductor pipe by imparting a loosening and a twisting moment to the core plug. The result is a significantly deeper drive distance for a conductor pipe equipped with the improved shoe before driving must be stopped and the core material drilled out of the conductor pipe.

6 Claims, 4 Drawing Figures

PENETRATION CONDUCTOR PIPE DRIVE SHOE

BACKGROUND OF THE INVENTION

It is customary in drilling oilwells through offshore rigs to drive an exterior conductor pipe, which is a string made up of segments of large diameter exterior pipe, to within the soil strata beneath an over water layer.

In general an offshore rig, such as a jack-up rig, will have a 60 foot air gap between the hull and the surface of the water. Above the hull there will be an additional approximately 30 foot distance to the working level of the rotary table. Beneath the water will be found loose, unconsolidated, generally sedimentary soils; at a greater depth will be found a harder, consolidated soil structure.

It is necessary to provide a continuous, cylindrical or casing structure to form the outer bore of an oilwell being drilled beneath the rotary table. The bore must be resistant to pressure and must support fluid flow, since an annulus formed by the casing structure is the containing region for reverse flow of drilling fluids and for containing any downhole kick pressures which are exterior to the drill string.

As a result, current technology drives a continuous string of external conductor pipe to define such an exterior bore. The conductor pipe is driven from a point immediately below the rotary to form a continuous, fluidly connected, pressure resisting string to a point deep enough within the consolidated soil under layer so as to resist washing out and blowout effects around the bottom of the conductor pipe. This typically involves at least 100 feet of soild penetration by cylindrical conductor pipe to set up a proper conductor string.

Conductor pipe is normally driven by an enclosed hammer in the manner of pile driving. However, since the conductor pipe is intended to form a cylindrical bore having a generally high tolerance diameter, within which is contained the oilwell casing and the tubular members of the drillstring, it is necessary that the conductor pipe remain a hollow cylinder and that it retain a circular cross section under the force of the driving. It is likewise important that the conductor pipe be driven in as straight a line as possible, since the geometry of the conductor pipe defines the center line of the oilwell bore and guides and directs the drillstring during subsequent drilling operations.

Current conductor pipe driving technology, like that for driving hollow cylindrical pilings for industrial construction, is a time consuming and expensive process. The procedure is complicated by several factors.

Viscous friction on the inner and outside circumference of the piling causes increasing resistance to penetration as the conductor pipe is driven deeper in the soil.

The necessity of retaining a cylindrical cross-section against the resistance encountered by the leading edge of the conductor pipe as it is driven by hammer blows, especially in dense, hard or irregular strata, currently results in the leading edge being chamfered with an outwardly inclined bevel section. The primary purpose of this chamfer is to avoid forces which would tend to collapse or crimp the edge of the conductor pipe, rendering the conductor string useless.

As a result of this outward bevel, essentially all of the soil that is displaced by the driving of the conductor pipe is compressed to an inner core, rising through the inner bore of the conductor pipe. As the conductor pipe penetrates, the resulting earth compression adds to the viscous friction on the inner wall of the pipe, and becomes the major contributor to force delaying the driving.

In turn, as a result of the resistance caused by the core earth within the conductor pipe, there is a need, under current driving procedures, to drill out this plug at frequent intervals, causing expensive delays.

Some prior art attempts have been made to plug the bottom end of the conductor pipe with a shaped shoe so as to prevent the core from forming within the pipe. This, however, dramatically increases the force needed to displace an earth volume equal to the conductor pipe to a region outside the zone of the conductor pipe, and increases driving forces to the point that the pipe normally cannot penetrate deep enough to properly engage a consolidated soil sub-layer.

SUMMARY OF THE INVENTION

I disclose a novel penetration shoe or driving end extension, to be fastened below the conductor pipe section. The invention significantly increases the driveability of a string of conductor pipe by decreasing the effects of external and internal viscous friction between the conductor pipe driven section and the soil. In addition, the resistance created by the compression of earth within the core of the conductor pipe is significantly reduced by novel construction of the interior of the drive shoe. Finally, I show a novel, inventive bottom end bevel and tooth structure which preserves the circular integrity of the lower end of the conductor pipe section, yet eliminates many of the adverse effects of the prior art inwardly tapering bevel by more symmetrically dividing the soil during penetration.

My invention has four major inventive components combined in its preferred form. First, I provide a symmetrical rather than a tapered bevel on the bottom and in the drive shoe. Such a bevel symmetrically divides the penetrated soil during the driving phase, and reduces the effect of compressing the soil to the interior core of the drive shoe section. In combination with the symmetrical bevel, I provide a plurality of toothed members extending outwardly from the ridge of the bevel. These teeth provide an even gripping bite, especially when the drive shoe encounters non-homogeneous components within the soil such as rocks or embedded areas of higher resistance. In combination, the tooth and bevel have at least an equal resistance to crushing or crimping effects on the end of the conductor pipe as does the prior art inwardly tapered bevel. In addition, the structure shown has an increased resistance to large scale deflections in the conductor pipe, driven direction, such as would occur should the pipe encounter a region of higher resistance, yet the pipe still retains the ability to deflect around major obstacles that would otherwise prevent the complete driving of the pipe; thus the pipe will achieve sufficient depth and penetration to provide a proper casing and sealing effect for the outer casing of the oilwell bore.

Additionally, I provide along the exterior of my drive shoe a plurality of spaced vertical bar members, having a tapered lower entrance cross-section for ready penetration. These bar members break the adhesion of the penetrated soil to the outside of the drive shoe and the exterior of the conductor pipe sections. Additionally the passage of these bars through the soil breaks up otherwise homogeneous or tight fitting soils, such as clays, decreasing adhesion and similar contributors creating viscous resistance to the penetration of the driven conductor pipe.

Within the interior of the drive shoe I provide a spiral array of periodic bar or linear penetrating elements. This inside spiral appears to have the effect of a corkscrew or auger, creating a twisting and a breaking up effect on the interior mass of the earth compressed into the core. The twisting effect or the spiraling effect tends to decrease the effect of compression caused by the beveled penetration on the mass of earth compressed into the core, by forcing the core material to travel along its outer edge a greater, twisting direction during the penetration of the drive shoe past the core. This unloads or puts a tension effect on at least an outer surface of the core, breaking up the homogeneity of the core and reducing penetration resistance due to compression. Again, as is true with the outer bars, the bars also break up the composition of the compressed soil as it passes through the drive shoe, reducing significantly the effects of adhesion and soil homogeneity upon the viscous friction encountered by the interior of the conductor pipe as it is driven through soil strata.

Finally, I mount the above features on a drive shoe section that has both an increased outer diameter and a decreased inner diameter from that of the conductor pipe to which it is attached. Thus, the passage of the drive shoe through a strata or layer of soil results in a decrease in compressive effect on the soil both inwardly and outwardly as the drive shoe passes and the conductor pipe itself encounters the soil. This produces a relaxing effect upon the outer and inner compressive forces against the soil for the remainder of the conductor pipe string, and contributes to the decreasing of the viscous friction between the conductor pipe and the soil.

It is thus an object of this invention to provide a drive shoe for attachment at the bottom end of the conductor pipe for significantly increasing driveability of the conductor pipe through soils.

It is a further object of this invention to show a structure for conductor pipe drive shoe which significantly decreases the viscous friction of contact of the soil with the conductor pipe.

It is a further object of this invention to show a construction for a conductor pipe drive shoe which significantly decreases the resistance due to compression of displaced earth during the driving of the conductor pipe.

It is a further object of this invention to show a structure for a conductor pipe drive shoe which decreases the disadvantages of an inwardly beveled tip, while preserving the resistance of crimping or deformation of the conductor pipe.

It is a further object of this invention to show a lower edge construction for conductor pipe drive shoe which increases the stability of drive direction against small inhomogeneities while preserving the driveability of the conductor pipe should major obstacles be encountered.

This and other objects of the invention can be more readily seen in the detailed description of the preferred embodiment and the claims which follow.

DETAILED DESCRIPTION OF PREFERRED EMBODIMENT

Figure 1:
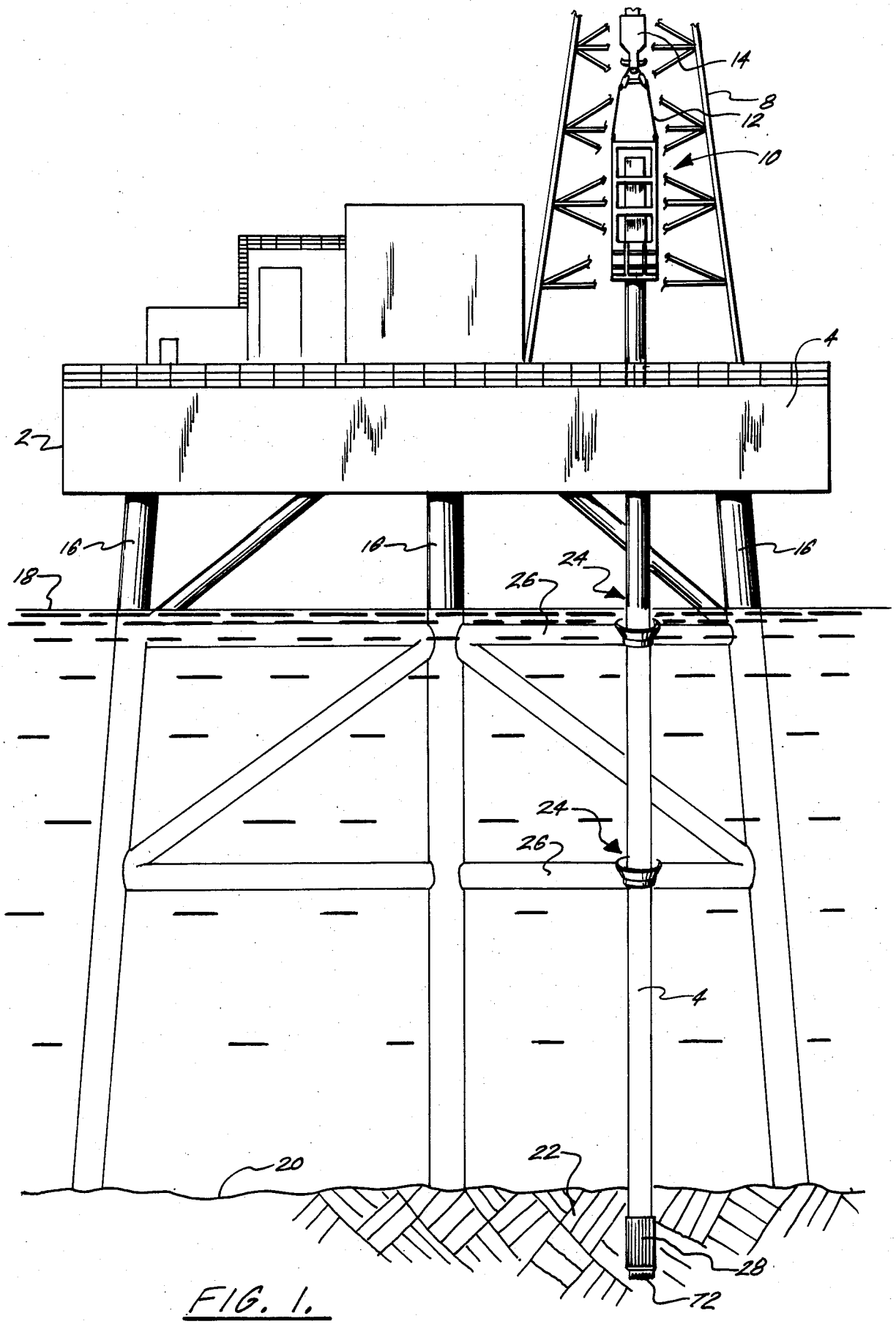
FIG. 1 shows in a cross-sectional side view a figurative offshore rig adapted for the driving of conductor pipe.

FIG. 1 shows, in simplified form, the general arrangement of an overall jack-up oil rig 2 during driving of conductor pipe 4. Within the oilrig 2 on a drill platform 6 is erected a drilling tower 8. Within the drilling tower 8 the conductor pipe 4 is driven by means of a steam hammer or compressed air hammer 10 suspended by a bridal 12 from a snatch block 14.

A jack-up rig 2 is normally installed upon platform legs 16 for support at a distance above a level of water 18, fixedly erected above a sub-sea level 20. The sub-sea level 20 or seafloor comprises a varying mixture of layers of strata of consolidated and unconsolidated soils 22, through which drilling operations will be conducted to reach sub-surface deposits, not shown.

The cost of an individual jack-up rig 2 is such that it is necessary to use the rig 2 to drill more than one well. As many as 40 individual oil wells can be drilled from a single rig 2. Primary support for each of these individual wells, in terms of providing an initial direction to the drillstring, as well as forming the outer casing and identity of the specific well, are the individual conductor pipe strings 4. One such is shown as an example in FIG. 1. The conductor pipe string 4 comprises a series of pipe elements of considerable size, directed through a plurality of pipe guides 24, found on transverse support members 26 of the platform legs 16. Typical conductor pipe sections are 40 feet long, 30 inches in diameter.

In order for the conductor pipestring 4 to provide a continuous outer casing and definition for the bore hole of the oilwell, it is necessary that the conductor pipe 4 be driven deeply enough in the soil 22 so as to form a sealed, continuous outer casing, relatively impervious to errosion, blowouts, and tunneling caused by the pressures that will later be encountered within the bore of the oil well which passes through the pipe 4. It is found in practice that it is typically necessary to drive such a conductor pipe 4 for at least 100 feet beneath sea bed level 20 in order to achieve such a sealing depth.

In summary, the average conductor pipestring 4 comprises a plurality of sections of approximately 40 feet length connected together and hammeringly driven into a seafloor 20. The driving force is provided by the impact of a hammer 10 upon an upper end of the string 4 and the penetration is accomplished by a lower end or driving end 28; significant forces are exerted by the resistance of soil 22 to penetration by driving end 28 and by pipe 4.

It will generally be found that the conductor pipe 4, having a driving end 28, can be dropped without much resistance into the sea bed 20 for a penetration distance of approximately 19 feet before coming to a halt, due to the resistance of the soil 22. For the remaining portion of the penetration distance, the conductor pipe 4 must be driven by repeated impacts delivered by the hammer 10 to the pipestring 4.

Figures 2, 3, 4:
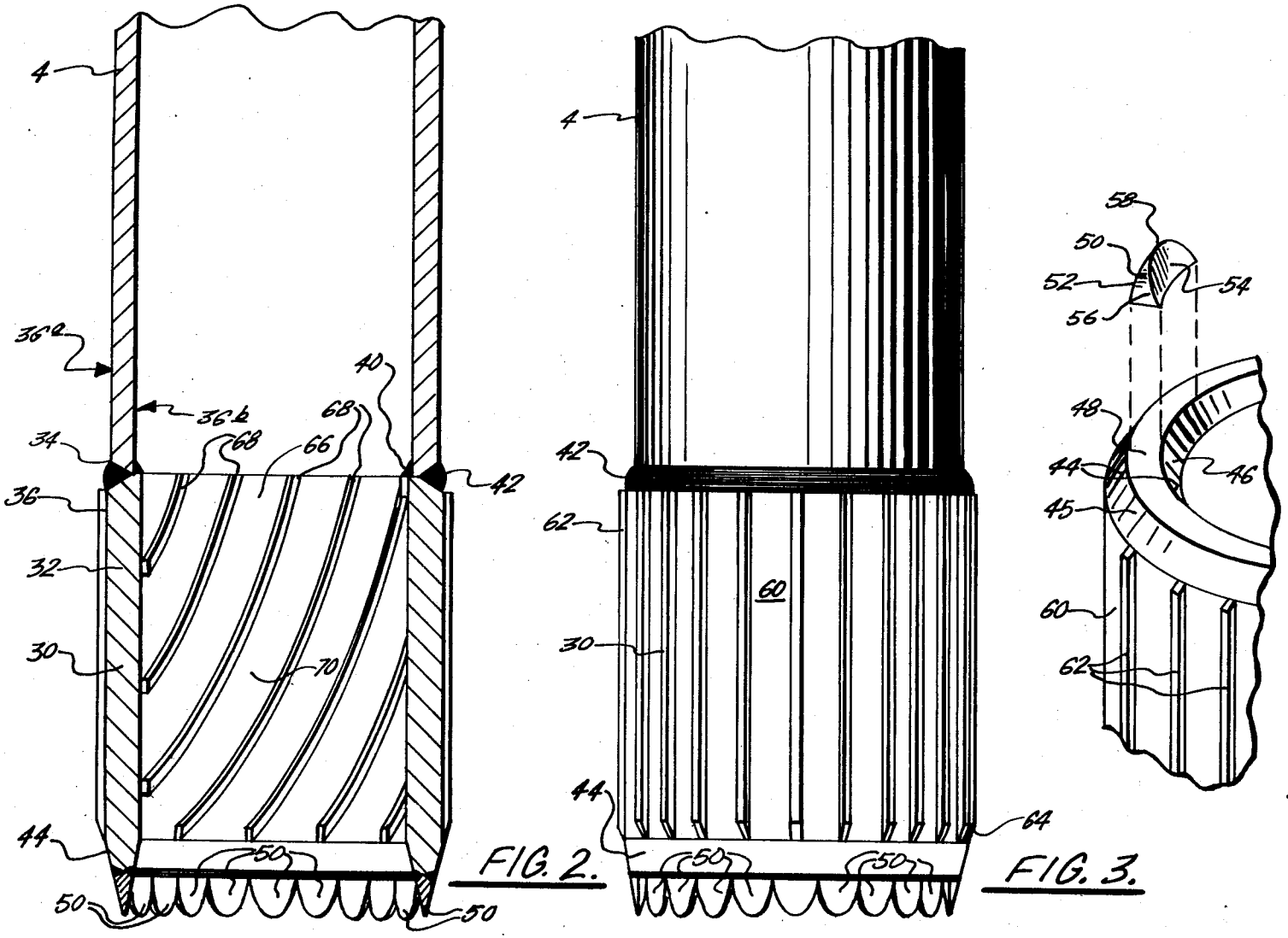
FIG. 2 shows a cross section of the drive shoe of the invention as connected to a section of conductor pipe, showing the interior thereof.
FIG. 3 is an exterior side view of the drive shoe of the invention as attached to a section of conductor pipe.
FIG. 4 is a section of the tip end of the drive shoe, inverted, showing a typical toothed member thereon.

The current invention forms a novel driving shoe 30, as shown in FIGS. 2, 3 and 4, which is installed upon and forms the driving end 28 of a conductor pipestring 4.

Driving shoe 30 comprises an increased size cylindrical member 32 co-axially, fixedly attached to a lower end 34 of conductor pipe 4. Cylindrical member 32 is of an overall increased thickness in comparison with the conductor pipe 4 so that exterior diameter 36 and interior diameter 38 of shoe 30 are respectively greater than the exterior diameter 36A and lesser thaan the interior diameter 36B of conductor pipe 4. Thus, cylindrical member 32 defines a substantially stronger lower cylindrical extension of increased resistance to deformation at the bottom end of conductor pipestring 4.

Cylindrical member 32 is fixedly attached to conductor pipe 4, co-axially conjoined with the center axis of conductor pipe 4 by means of an inner weld 40 annularly, circumferentially extending around an inner point of contact between member 32 of pipe 4 and by means of a penetrating, beveled outer well 42, substantially connecting lower end 34 conductor pipe 4 to cylindrical member 32 of driving shoe 30. The resulting structure is a downwardly extending extension of conductor pipe 4, having the property that its exterior diameter is greater than that of pipe 4 yet its interior diameter is less than that of pipe 4.

The lower end of driving shoe 30 terminates in a symmetrical bevel 44. Bevel 44 is formed by identically angled outer bevel face 45 and inner bevel face 46 which define a bevel having a symmetrical meeting point intermediate the inner diameter 38 and outer diameter 36 of driving shoe 30. The overall form of bevel 44 is such that it provides a displacing bias to soil 22 that is symmetrical in the sence that it neither urges a greater amount of soil 22 inward along face 46 nor outward along face 45, but rather evenly divides the material being penetrated. In the preferred embodiment face 45 and face 46 are respectively inward and outward 22.5 degree angle facings with respect to the axis of cylindrical member 32.

Bevel 44 does not come to a point, but rather is truncated to form a lower flat surface 48 at the lower end of driving shoe 30. Surface 48 forms a ring surface essentially perpendicular to the axis of driving shoe 30. Upon truncated ring face 48, in repeated circumferential array are mounted a plurality of teeth members 50 to form a continuous periodic tooth edge about the lower edge of circumferential member 32, facing in a lower, soil contacting direction. Each of teeth 50 in turn comprises a hardened material section having a triangular cross section 52 and a semi-circular lengthwise section 54, which rise from an essentially flat base member 56 to a penetrating edge 58.

Repeatedly mounted about the exterior wall 60 of drive shoe 30 are found the plurality of outer driving bars 62. In the preferred embodiment outer bars 62 are rather more rectangular than square in cross-section, being welded on a narrower side to exterior wall 6 and extending in an outer direction therefrom. Each of the outer bars 62 terminate in an angled lower face 64.

As shown in FIG. 2 the interior wall 66 of driving shoe 30 has mounted, extending inwardly upon it, a plurality of interior spiral bars 68. In the preferred embodiment bars 68 are of a more square cross-section shape due to the requirement that their strength be increased to receive angled forces. Each of the bars 68 is fixedly mounted to interior face 64 as by welding in a manner such that they extend vertically upwards from a point adjacentbevel inner face 46 to the upper end of drive shoe 30. More importantly, each of bars 68 rises at an angle so as to form a periodic, interdigitated, inner spiral structure within drive shoe 30. This spiral structure 70 is analogous to an auger or cork screw spiral.

As an example, in one preferred embodiment of the drive shoe, for a conductor pipe of 30 inch nominal diameter, the cylindrical member 32 has an exterior diameter 36 of 30⅜ inches, and an interior diameter 38 of 27 inches. The conductor pipe 4 is nominally 30 inch diameter having a 1 inch wall thickness and thus a 28 inch interior diameter.

In such a construction, the overall length of driving shoe 30 is approximately 3 feet 3 inches. There are approximately 23 outer driving bars 62, nominally ¼ inch thick, extending ⅜ an inch outward from exterior face 60. There are approximately 11 interior bars 66, nominally ⅜ inch square and welded in a spiral configuration 70 such that the bars are laterally transitioned 22½ inches from a lower to an upper end, in a vertical plane dropped from the apex of the bars.

Each of teeth 50 are ⅝ inches wide, defined at the point where triangular cross-section 52 meets base 56; they are 1½ inches long, defined at a line where semi-circular section 54 meets face 56. Semi-circular section 54 is nominally 1¼ inch radius. Triangular section 52 is tapered at a 65 degree angle at the tip of penetrating edge 58 to base 56. Bevel 44, by contrast, is angled such that inner face 46 and outer face 45, if extended, would define a 45 degree angle.

In operation, driving shoe 30 is attached, by welding through inner annular weld 40 and outer circumferential weld 42 to the bottom of a conductor pipe string 4. The then assembled conductor pipe string 4, descending through pipe guides 24 is made up and lowered into contact with soil 22 until resistance stops downward motion of conductor pipe under gravity.

Hammer 10 is then activated to provide a repeated, pounding hammering effect upon conductor pipe string 4, and thus downwardly upon driving shoe 30 against soil 22.

The penetrating edge 58 of teeth 50 act to provide an initial bite and direction guide into soil 22. Teeth 58 will bite into and prevent deflection by relatively small inhomogeneities within soil 22. By contrast, if an obstacle such as a rock, physically larger than the overall diameter of conductor pipe 4, is encountered, the dual angle of teeth 50 and the somewhat less acute angle of bevel 44 will combine to deflect conductor pipe 4 around the object contacted so that the driving may continue rather than being brought to a complete stop. The increased cross-sectional area and strength of cylindrical member 32 due to its increased exterior diameter 36 and its reduced interior diameter 38, all as reinforced by teeth 50, the symmetry of bevels 44, the plurality of outer bars 62 and interior spiral bar 68, prevent this deflecting force from collapsing or crimping the end bevel 44 of driving shoe 30, and thus prevent the collapse or crimping of conductor pipe 4.

Due to the overall symmetry of triangular cross section 56 and bevel 44, the downward driving effect of conductor pipe shoe 30 divides soil 22 evenly so that essentially half of ther displaced soil 22 is displaced along the exterior face 60 of the drive shoe 30 and half the soil is displaced along the interior face 66 of the drive shoe 30.

The soil displaced in sliding engagement with face 60 is broken up by the plurality of vertical bars 62. Bars 62 have the twin effects of breaking the soil 22 into small particles, more easily displaced and moved, at the same time reducing viscous effects which would drag upon face 60 and pipe 4. Further the decrease in exterior diameter between exterior diameter 36 of shoe 30 and the lessened exterior diameter of conductor pipe 4 provides an area of loosened soil immediately adjacent the exterior of conductor pipe 4 and thus significantly decreases long term viscous drag upon the exterior of conductor pipe 4 as it is driven through soil 22.

The resistance to the driving of conductor pipe 4 by the soil compressed within the interior wall 66 of drive shoe 30 is composed of two primary components. The first is the contact or viscous drag of the compressed core 72 driven into the interior of drive shoe 30, against and along interior wall 66. In addition, the displacement of the soil 22 to an interior point by inner bevel face 46 attempts to compress soil 22. Inasmuch as soil 22 is presumably a water saturated soil, and may be fairly consolidated, it is extremely resistant to such compressive effects, and the effort required to compress the soil 22 comprises a significant portion of the overall resistance to the downward driving of conductor pipe 4. In fact, in practice, it is found that repeated activation of hammer 10 will produce a gradually lessening driving effect on conductor pipe 4 until such time as conductor pipe 4 essentially does not move between strokes of hammer 10. At this point it is necessary to remove hammer 10 and install a standard drilling apparatus from traveling block 14, to drill core 72 out from within the interior of conductor pipe 4. The removal of core 72 is found to permit continued driving of conductor pipe 4, and it is considered indicative that the combination of compression and viscous friction of the interior core 72 is a principal constituent of the overall drag against driving of pipe 4.

The interior bars 68 form an overall spiral 70. The contact of these bars with core 72 of soil 22 produces a twisting effect upon the core 72, and, as can be seen, transitions the core 72 a greater distance than the vertical descending distance of drive shoe 30. Thus, in addition to the loosening and viscous friction reducing effects of bars 68 which are analogous to those of outer bars 62, the spiral 70 formed by bars 68 tends to significantly reduce the immediate compressive effects of the soil forming core 72. Further, inasmuch as interior diameter 38 is less than the interior diameter of conductor pipe 4, core 72, once it has passed the length of driving shoe 30, can expand slightly into the greater interior diameter of conductor pipe 4. It is believed that the combined effects of the spiral 70 upon that portion of the core 72 in contact with driving shoe 30, together with the loosening effect of the interior bars 68 and the expansion of interior diameter between interior diameter 38 of the interior diameter of pipe 4 are such as to significantly decrease the resistance provided to driving of conductor pipe 4 by interior core 72.

It is the inventor's belief that the resistance to the driving of conductor pipe 4 is primarily composed of those effects described above. It has been demonstrated by test that a conductor pipe shoe of this design permitted a conductor pipe 4 to be driven a distance of 230 feet into a mixture of soils on a single driving sequence without the drilling out of a core 72; by comparison a conductor pipe of the prior art in the same soil was only driven 73 feet before it was necessary to drill the core 72 from the conductor pipe to resume driving. Note in each case that the depth to which a pile or pipe can be driven is that standard in the art of pile driving, that is the depth or the point at which a given number of blows will not move the pipe downward more than some ascertainable minimal distance.

Although a very specific combination example has been described and disclosed above, the invention of the instant application is considered to comprise that wider range of equivalents as are given in the claims. In particular, the inventor has disclosed a combination incorporating all of the drive resistance reducing features invented by him, and it is not thereby admitted that the drive resisting features of his invention are not individually inventive and claimable.

I claim:

1. An apparatus for increasing the impact driveability of a piling linearly along an axis through contacting soil comprising:

a. A first, lower, soil displacing section of said piling;

b. soil contacting means, outwardly disposed from (an exterior face of) said section, for intermittently de-cohering said soil; and c. Means, inwardly disposed from said section, for torsionally disassociating said soil.

2. An apparatus for increasing the impact driveability of a piling linearly along an axis through contacting soil comprising:

a. A lower, soil displacing section below said hollow piling, adapted for penetrating said soil for driving said piling;

b. Said section defining an interior core of said soil upon driving; and c. Means, inwardly disposed from section, for torsionally disassociating said core.

3. The apparatus as described in claim 2 above wherein said means further comprise(s):

a. A plurality of inwardly extending, soil contacting elements, disposed within said section;

b. Said elements torsionally engaging said core in a substantially angled direction with respect to the axis of the pile.

4. An apparatus, for attachment to the lower end of a hollow piling, adapted for increasing the driveability of said piling along an axis into soil, comprising:

a. A lower soil contacting end of said piling;

b. Means upon said end for displacing said soil during the driving of said piling;

c. Said displacing means further comprising:

A substantially symmetrically beveled angle of entry.

5. The apparatus as described in claim 4 wherein said displacing means further comprises:

a. a lower first, soil displacing symmetrical angle;

b. an upper second, soil displacing angle intermediate said first angle and said apparatus;

c. Wherein said first soil displacing angle is more acute than said second soil displacing angle.

6. An apparatus for increasing the impact driveability of a hollow piling linearly downward through contacting soil comprising:

a. A hollow driving shoe section fixably attached to said piling at an initial soil displacing end of said piling, symmetrically adapted to the shape of said piling;

b. A plurality of substantially vertical soil de-cohering bars, circumferentially extending outward from said shoe;

c. A plurality of interior angled bars, inwardly disposed within said shoe, torsionally engaging said soil; and d. A lower end of said drive shoe section, said lower end further comprising:

1. A substantially symmetrical soil displacing bevel adapted to symmetrically displacing soil within and without said section.

* * * * *